United States Patent [19]

Nakonechny et al.

[11] Patent Number: 5,037,609

[45] Date of Patent: Aug. 6, 1991

[54] MATERIAL FOR REFINING STEEL OF MULTI-PURPOSE APPLICATION

[76] Inventors: Anatoly Y. Nakonechny, ulitsa Kuibysheva, 195, kv. 56; Alexandr J. Zaitsev, ulitsa Somova, 24, kv. 71, both of Donetsk; Manat Z. Tolymbekov, ulitsa Botanicheskaya, 14, kv. 57, Karaganda; Jury F. Vyatkin, ulitsa Pirogova, 202, kv. 24, Moscow; Vasily S. Kolpakov, ulitsa Kosmonavta Belyaeva, 34, kv. 34, Cherepovete, all of U.S.S.R.

[21] Appl. No.: 603,727

[22] PCT Filed: Mar. 17, 1989

[86] PCT No.: PCT/SU89/00070

§ 371 Date: Nov. 9, 1990

§ 102(e) Date: Nov. 9, 1990

[87] PCT Pub. No.: WO90/11384

PCT Pub. Date: Oct. 4, 1990

[51] Int. Cl.[5] ..... C22C 35/00

[52] U.S. Cl. ..... 420/580; 420/578; 420/581

[58] Field of Search ..... 420/581, 578, 548, 580; 148/419, 442; 75/305

[56] References Cited

U.S. PATENT DOCUMENTS

| | | | |
|---|---|---|---|
| 963,345 | 7/1910 | Willson et al. | 420/578 |
| 4,162,159 | 7/1979 | Peregudov et al. | 420/581 |

FOREIGN PATENT DOCUMENTS

| | | |
|---|---|---|
| 0025246 | 7/1972 | Japan . |
| 0577247 | 10/1977 | U.S.S.R. . |
| 1381166 | 3/1988 | U.S.S.R. . |

*Primary Examiner*—R. Dean
*Assistant Examiner*—Sikyin Ip
*Attorney, Agent, or Firm*—Burgess, Ryan & Wayne

[57] ABSTRACT

The claimed material for refining steel of multi-purpose application contains the following components in the following proportion, % by mass:

| | |
|---|---|
| aluminium | 30–40 |
| silicon | 35–25 |
| calcium | 5–15 |
| magnesium | 7–5 |
| carbon | 20–10 |
| iron | the balance. |

3 Claims, No Drawings

MATERIAL FOR REFINING STEEL OF MULTI-PURPOSE APPLICATION

TECHNICAL FIELD

The invention relates to metallurgy and has specific reference to the materials for refining steel of multi-purpose application.

BACKGROUND OF THE INVENTION

Steel of multi-purpose application is a term used in reference to the steel of the following composition, % by mass:

| | |
|---|---|
| carbon | 0.05–0.5 |
| manganese | 0.25–2 |
| iron | the balance. |

Steel of multi-purpose application may also contain (% by mass) such elements as:

| | |
|---|---|
| silicon | up to 0.6 |
| aluminium | up to 0.08 |
| chromium | up to 2 |
| vanadium | up to 0.2 |
| titanium | up to 0.2. |

The presence of other elements is not excluded as well.

In world steelmaking practice, confined to the ladle are now the following operations: alloying, desulphurisation, modification and the removal on nonmetallic inclusions, degassing, i.e. the reduction of oxygen, nitrogen and hydrogen content.

The alloying and refining are carried out in succession. The steel is alloyed by adding various ferroalloys and then it is refined by such techniques as the application of vacuum or the introduction of powdered material with the aid of a jet of an inert gas.

Considerable heat losses are involved during each operation of alloying and refining. To compensate for the losses, the metal must be overheated in the furnace and tapped at a temperature above normal or it must be heated up in the ladle, using certain means.

However, both ways are irrational in the making of steel for multi-purpose application. Firstly, an increase in the solubility of oxygen at high temperatures results in a higher than normal oxidation of the metal. This calls for using more deoxidisers which contaminate the steel by the nonmetallic inclusions resulting from the reaction and impair product quality. Secondly, the extra heating up with special means adds to the costs, for such means must be purchased and installed, and also extends the period of treatment, reducing plant capacity.

All in all, the cost of steel rises—a fact which is not justifiable as far as the production of steel for multi-purpose application is concerned.

Known in the art is a material for the refining of molten metal (EP, A1, 0192090) which has a composition (% by mass) as follows:

| | |
|---|---|
| silicon | 40–80 |
| titanium | 10–20 |
| magnesium | 1.5–3 |
| calcium | 0–0.5 |
| aluminium | 0–2 |
| rare-earth elements | 0–2 |

-continued

| | |
|---|---|
| iron | the balance. |

However, the known material is ineffective in removing sulphur and nonmetallic inclusions, for the percentage of the oxygen dissolved in the molten metal is low.

The content of reactive agents, i.e. deoxidisers—aluminium, magnesium, calcium and rare-earth elements—which are also strong desulphurising additives and strong modifiers of nonmetallic inclusions, is low in the known material. The available deoxidisers effectively eliminate the oxygen dissolved in the molten metal when the known material is added thereto but they appear to be in short supply for the desulphurisation and modification to take place.

Apart from that, the titanium which is present in the known material for refining forms high-melting oxides. Rising to the surface, these oxides render the slag more viscous and less effective as the sorbent of sulphur and nonmetallic inclusions. These unwanted substances remain in the metal, impairing the quality thereof.

The known refining material, if used as the source of alloying elements reduced form oxides contained therein, is of no avail in producing metal of a conditioned composition. The silicon contained in the known refining material has a high affinity for oxygen but it is also a reducing agent of a strength inferior to that of aluminium, magnesium and calcium. Therefore, the reaction yields acidic oxides of silicon which increase the viscosity of the slag and reduce the reactivity of the alloying element contained in the slag. This has an adverse effect on the reduction of alloying element. Also, the process of desulphurisation is difficult due to an impaired ability of the slag to remove sulphides and act as the sorbent of nonmetallic inclusions.

All the above factors spoil the quality of steel. Also known is a material for refining (SU, A, 456,032) of the following composition, % by mass:

| | |
|---|---|
| manganese | 48–60 |
| silicon | 28–32 |
| aluminium | 6–12 |
| calcium | 0.4–3 |
| magnesium | 0.3–2 |
| carbon | 0.06–0.3 |
| phosphorus | 0.04–0.35 |
| sulphur | 0.01–0.02 |
| iron | the balance. |

However, this material cannot boast good results as far as the degree of desulphurisation and removal of nonmetallic inclusions is concerned.

The explanation is the qualitative and quantitative composition of the known material. In the first place, the percentage of the elements with a high affinity for oxygen—such as calcium, magnesium, aluminium and silicon—is low.

In the second place, it contains phosphorus and sulphur which are unwanted admixtures.

In the third place, there is an abundance of manganese which reacts with the sulphur to form a low-melting manganous sulphide—a substance which readily dissolves in the molten metal and interfers with the slagging of sulphur.

In the fourth place, the carbon is present in the known material as an admixture so that extra carbon is required for refining the metal. This involves an increase in the sulphur content of the metal and a degrading of product quality.

The use of the known material as an oxide-containing alloying additive is impractical. Although, there are elements which eagerly react with the oxygen of oxides, their percentage is low. The degree of reduction is consequently low as well so that no steel of specified composition can be produced. Desulphurisation and the removal of other nonmetallic inclusions are totally absent so that no quality stell can be made.

SUMMARY OF THE INVENTION

The principal object of the invention is to provide a material for refining steel of multi-purpose application which will improve desulphurization of steel and removal of nonmetallic inclusions therefrom by using a certain proportion of its components.

This object is realized by disclosing a material for refining steel of multi-purpose application containing aluminium, silicon, magnesium, carbon and iron, wherein, according to the invention, these components are present in the following proportion, % by mass:

| | |
|---|---|
| aluminium | 30–40 |
| silicon | 35–25 |
| calcium | 5–15 |
| magnesium | 7–5 |
| carbon | 20–10 |
| iron | the balance. |

The disclosed material is suitable for refining steel in the course of alloying which is being accomplished by either adding ferroalloys or reducing the alloying elements from their oxides.

The disclosed material for refining steel of multi-purpose application permits the making of steel with a minimum content of sulphur and other nonmetallic inclusions. This is achievable owing to the presence of more than one element with a maximum affinity for oxygen.

The fact that these elements are present in the specified proportion cares for the deoxidation to take place concurrently with an unhindered shaping of globules of the nonmetallic inclusions which are disposed of eventually with the flushing slag. Passing over into the slag are the sulphides resulting from the desulphurization of steel of multi-purpose application which occurs also at the same time.

These steps are conducive to improving the quality of steel of multi-purpose application.

The disclosed material for refining may be employed in the form of either mixture or alloy. The mixture can be composed of pure materials with a maximum content of the principal element. Pure materials can be mixed with compounds, e.g. carbides of calcium or silicon or these carbides can be mixed with an aluminium-, magnesium-or iron-bearing alloy.

It is expedient to employ the disclosed material for refining during ladle treatment of the steel for multi-purpose application.

It is also preferred to employ the disclosed material in alloying steel with manganese which is reduced from the material containing the manganese in the form of oxides.

The slag formed during the process of refining is a free-running one which readily separates from the metal. It is also a good sorbent of sulphur and nonmetallic inclusions. Apart from that, the slag is a good heat insulator which gives the metal a reliable protection against cooling and secondary oxidation. A quality steel with a low content of sulphur and nonmetallic inclusions is so produced.

The disclosed refining material is rich in elements reactive towards oxygen which deoxidize the metal in the ladle and reduce alloying elements from the oxides. Desulphurization and the removal of other nonmetallic inclusions take place at the same time.

An addition of a material with oxides of the alloying element to the disclosed refining material prevents the burning-out of the elements reactive towards oxygen which are contained in the disclosed refining material.

The material containing oxides of the alloying element rapidly dissolves in the ladle and forms a layer of slag which prevents oxidation of the elements having affinity for oxygen by the oxygen of the atmosphere.

Concurrently with the reduction of the oxides of alloying elements spreading uniformly over the volume of the metal, the process of refining goes on. The reactions are exothermic ones so that there is no need to preheat the metal in the furnace or ladle. This not only improves product quality but saves cost.

An aluminium and silicon content of the disclosed refining material amounting to 30–40 and 25–35%, respectively, fully meets the requirements of metal deoxidation. This creates favourable conditions for desulphurization and provides for a percentage recovery of the alloying element from the oxide which is as high as 95%. Complex aluminium and silicon compounds formed in this case readily rise to the surface. Being of the low-melting nature, they do not impair the fluidity of the slag and have therefore no adverse effect on the sorbing power thereof.

An aluminium content of the disclosed refining material which is less than 30% calls for rising the silicon content up to over 35% and has therefore an adverse effect on the reduction of the alloying element from its oxide. The percentage of bisilicates—products of oxidation of the silicon—increases in the slag and the reactivity of the alloying element contained in the slag decreases. The slag gets viscous, the mass transfer therein gets worser and the sorbing power of the slag with respect to sulphur decreases. The steel quality is degraded.

An increase in the aluminium content over 40% reduces the silicon content below 25%. This is impractical, preventing an increase in the percentage recovery of the alloying element. Alumina inclusions increase in the steel, impairing its quality.

Also, the cost of the refining material increases, adding to the first cost of the steel. This is not justifiable in the production of steel for multi-purpose application.

A calcium content of the disclosed refining material which is between 5 and 15% is conducive to obtaining low-sulphur steel. The calcium/magnesium combination produces a morphological effect, giving rise to uniform distribution of the nonmetallic inclusions in the form of globules.

A calcium content under 5% prevents the production of low-sulphur steel and is incompatible with product quality.

An introduction of calcium in an amount exceeding 15% of the material invites difficulties stemming from high vapour pressure and good affinity for oxygen which are inherent un calcium. But the main thing is that high calcium content does not improve product quality. No further decrease in sulphur content takes place but the cost of the material and that of the steel rises.

A magnesium content of the disclosed refining material al which is 5–7% is conducive, in combination with the calcium, to a low sulphur content of the steel. The nonmetallic inclusions diminish in size, acquire globular form and uniformly distribute over the volume of the metal. This has a positive effect on product quality.

A magnesium content under 5% is too low to have an influence on the modification of nonmetallic inclusions. A content over 7% has no bearing on product quality.

A carbon content of the disclosed refining material which is 10–20% provides for alloying the steel with the carbon with a high percentage recovery. Some of the carbon goes to deoxidize the metal without contaminating it, for the product of the reaction is a gas-carbon monoxide. A high degree of metal deoxidation paves the way effective desulphurization and the removal of other nonmetallic inclusions.

A carbon content under 10% makes an addition of extra carbon unavoidable. The sulphur which is added in this case with the carboniferous material increases the sulphur content of the steel, degrading its quality due to the presence of sulphide and oxysulphide inclusions.

A carbon content over 20% makes the disclosed material not quite suitable in treating low-carbon steel. Insufficiency of the compounds taking an active part in the process of refining the steel is another aftereffect.

An iron content of the disclosed material which is 5–15% is exactly one which is needed in order to impart the material a density enabling it to sink to the metal-slag interface. The alloying elements are reduced there from the oxides contained in the slag.

An efficient refining of the metal to remove sulphur and other nonmetallic inclusions therefrom takes also place. The specified carbon content facilitates the introduction of carbon into the disclosed refining material when this is being used in the form of alloy, for the iron increases the solubility of the carbon.

An iron content under 5% fails to introduce carbon into the refining material in a requisite amount and reduces the density of the material which can stay in the slag. The elements which are reactive towards oxygen burn out in this case.

An iron content over 15% is not desirable. The density of the refining material excessively increases and the material sinks deep into the metal. This badly affects the process of reduction of the alloying elements which is confined to the slag-metal interface anf reduces the content of the elements reactive towards oxygen and sulphur. A degrading or product quality is inavoidable.

It is also expedient to introduce rare-earth elements into the disclosed refining material. Being extremely active with respect to the elements of introduction—$O_2$, N, H, S—the rare-earth elements owe their modifying and refining power to this property. The modifying power is attributed to surface tension variations at the interface between the liquid and solid phases. This affords control over the process of primary solidification so as to change the degree of dispersion of the solidifying phases. A dispersed heterogene structure of the cast steel is a prerequisite of fine-grained structure of the rolled product.

Apart from that, the free energy of rare-earth sulphides is more negative than that of sulphides of other metals. For example, no easily deformable manganous sulphides would form in the presence of rare-earth elements, for it is the turn of the inclusions—sulphides of rare-earth elements—which form before all and only then come the complex oxysulphide inclusions which give no rise to threads in the course of rolling. The presence of rare-earth elements in steel in the specified amount prevents flocculation.

It is advisable that the composition (% by mass) of the material for refining steel of multi-purpose application is as follows:

| | |
|---|---|
| aluminium | 30–40 |
| silicon | 30–25 |
| calcium | 15–5 |
| magnesium | 5–7 |
| carbon | 10–20 |
| rare-earth elements | 5–1 |
| iron | the balance. |

A reduction of the silicon content of the disclosed refining material from 35–25 to 30–25% by mass provides for decreasing the total amount of nonmetallic inclusions, i.e. silicates, which are present in the steel. The rare-earth elements introduced additionally in an amount of 1–5% serve as modifying additives dispersing the remnants of nonmetallic inclusions, such as hercynite ($FeO.Al_2O_3$), $CaO.Al_2O_3$, $Al_2O_3$ and the like. The outcome is low-sulphur quality steel which contains nonmetallic inclusions of favourable shape and composition and acquires fine-grain structure when rolled.

It is desirable that the disclosed material for refining steel of multi-purpose application is of the composition (% by mass) as follows:

| | |
|---|---|
| aluminium | 30–40 |
| silicon | 35–25 |
| calcium | 15–5 |
| magnesium | 5–7 |
| carbon | 10–12 |
| rare-earth elements | 1–2 |
| iron | the balance. |

A reduction of the carbon content of the disclosed refining material from 10–20 to 10–12% by mass widens the field of application of the material, rendering it suitable for treating low-carbon steel with a carbon content of 0.1% by mass or less. The rare-earth elements introduced additionally in an amount of 1–2% by mass act as a grain refining agent. They also enhance the desulphurizing effect of other components of the material which show high affinity for oxygen—aluminium, silicon, calcium and magnesium—and take care of deep ladle deoxidation as well as desulphurization of the metal. The desulphurizing and refining properties of the rare-earth elements reduce the content of nonmetallic inclusions and add to the quality of steel.

To adapt the process of preparing the disclosed refining material for streamlined operation and reduce cost, it is recommended to introduce calcium, silicon and carbon in the form of commercially available products, e.g. carbides of calcium and silicon. These materials are inexpensive and pose no handling and storing problems.

While calcium carbide is a good desulphurizing and carboniferous agent, silicon carbide promotes slag-making, speeds up desulphurization and is an effective sorbent of nonmetallic inclusions.

The disclosed material for refining steel of multi-purpose application markedly improves product quality by virtue of decreasing the content of sulphur and nonmetallic inclusions.

Best Mode for Carrying Out the Invention

The disclosed refining material is prepared on the following lines.

A 5-ton charge of aluminium and magnesium is heated to 600°-650° C. in an induction furnace, and an inert gas atmosphere is set up at the surface of the melt before this is heated to 1000°-1100° C. and iron is added to the bath. The molten metal is homogenized, cooled to 550°-600° C. and cast into cast iron trays. On cooling down, the material is comminuted as required. A vacuum induction furnace operating at the same temperature can be used to prepare the refining material.

The ground material is mixed with carbides of calcium and silicon and placed into the ladle assigned for removing sulphur and other nonmetallic inclusions from steel of multi-purpose application.

The disclosed refining material is used in the following way. The material liable to refining can be made in a plant of any known kind: open-hearth furnace, electric furnace or a converter blown at the top, bottom or both at the top and bottom whereby the blast may consist of a mixture of oxygen with a gas, an inert gas or a mixture of inert gases.

The metal tapped from the steelmaking plant is a semifinished carbon product of the following composition, % by mass:

| | |
|---|---|
| carbon | 0.05-0.3 |
| manganese | 0.05-0.1 |
| silicon | traces |
| aluminium | traces |
| sulphur | up to 0.03 |
| phosphorous | up to 0.025 |
| iron | the balance. |

The choice of the steelmaking plant depends on the requirements which should meet any particular kind of steel for multi-purpose application and can be made by the steel maker.

The semifinished carbon product is tapped from the steelmaking plant into a ladle of a capacity which corresponds to, or is a multiple of, that of the plant. Concurrently with pouring the semifinished carbon product into the ladle, fed thereinto are ferroalloys or a material containing the alloying elements in the form of oxides and also the disclosed material for refining steel of multi-purpose application. All these materials should be added before the pouring operation is over.

Used as oxide sources can be materials containing oxides of manganesem chromium, vanadium and titanium. They can be fed into the ladle separately or in various combinations depending on the specified composition of the steel which should be obtained.

The ladle reduction of the alloying elements from the oxides is a short process which comes practically to an end by the time the pouring of the semifinished carbon product is finished. The percentage recovery of the alloying elements is up to 90-97%.

The desulphurization and removal of other nonmetallic inclusions goes on concurrently with the alloying and is completed at the end of the pouring. This improves product quality and saves costs.

The disclosed refining material, if used in ladle alloying steel of multi-purpose application in conjunction with ferroalloys, also adds to product quality, but to a lesser extent. The explanation is that in tapping the semifinished carbon product from the steelmaking plant, some slag enters the ladle from the furnace. The heavily oxidized furnace-originated slag not only brings about extra burning out of the deoxidizer but impedes desulphurization so that the content of nonmetallic inclusions rises. The totally reduced phosphorus of the slag passes over into the steel. Any attempt to isolate the furnace slag and to fuse a new one from self-melting slag-making mixtures, or to use synthetic slag, complicates the process and impairs plant capacity. Causing also an increase in costs, this practice not always turns to advantage in making steel of multi-purpose application.

Therefore, it is preferred to employ the disclosed refining material when the alloying is carried out by a recourse to oxides.

Since the disclosed refining material and the material containing the alloying oxides are added in the course of pouring the semifinished carbon product into the ladle, only a minimum of the elements with a high affinity for oxygen, present in the disclosed refining material, is subjected to burning out. In melting during the pouring, the material containing oxides of the alloying elements forms a layer of slag at the surface of the molten semifinished carbon product which isolates the disclosed refining material from the oxygen of the atmosphere. A deeply deoxidized metal lending itself readily to desulphurization is produced, the product quality is improved.

The disclosed material for refining steel of multi-purpose application can be prepared in the form of a mixture comprising calcium carbide, silicon carbide and an aluminium-magnesium-iron alloy. This mixture lends itself to streamlined production better than the mixtures wherein the components are present in a pure form with a maximum content of the principal element; it is also cheaper.

The silicon carbide used for preparing the mixture was of the following composition, % by mass: SiC, 97.82; Si, 0.17; $SiO_2$, 0.12; $Al_2O_3$, 0.9; $Fe_2O_3$, 0.43; CaO, 0.3; MgO, 0.26. The composition of the calcium carbide was in % by mass: $CaC_2$, 78.9; CaO, 17.3; $Al_2O_3$, 1.6; $SiO_2$, 0.8; $Fe_2O_3$, 0.5; MgO, 0.9.

The aluminium-magnesium-iron alloy was prepared by fusing the aluminium and magnesium at 600°-650° C. in a basic-lined induction furnace, using a crucible. The temperature was then increased to 1000°-1100° C. and an inert gas was fed onto the surface of the melt before the iron was added batchwise thereto. On allowing the iron to dissolve, the melt was cooled to 550°-600° C. and poured on cast iron trays. A comminution of the alloy to a specified particle size completed the preparation.

To prevent oxidation of the magnesium and aluminium, the alloy can be produced in a vacuum induction furnace.

The disclosed refining material can also be employed in the form of an alloy. Firstly, this simplifies storage, processing and the feeding of the material into the ladle. It is neither hygroscopic as calcium carbide nor highly abrasive as silicon carbide which needs special mixers. Secondly, the refining material provided in the form of an alloy is homogenous, i.e. of uniform chemical composition, and has a uniform density. A stability of the ladle refining process is guaranteed in this case. Thirdly, the composition of the alloy provides a means of controlling the reactivity of the components towards oxygen, sulphur and nonmetallic inclusions.

The melting and pouring techniques and the temperatures used are identical with those employed in preparing the aluminium-magnesium-iron alloy.

The charge material was as follows:

aluminium of a composition, % by mass: Al, 99.8; Fe, 0.12; Si, 0.01; Cu, 0.01; Zn, 0.04; Ti, 0.02;

crystalline silicon of a composition, % by mass: Si, 98.8; Fe, 0.5; Al, 0.5; CaO, 0.2;

metallic calcium of a composition, % by mass: Ca, 98.96; Al, 0.1; Mg, 0.5; Mn, 0.05; N, 0.06; oxygen, 0.3; Fe, 0.01; Si, 0.02;

metallic magnesium of a composition, % by mass: Mg, 98.6; Ca, 0.3; Al, 0.5; Si, 0.2; Mn, 0.1; Cu, 0.3;

carbon in the form of scrapped graphitised electrodes of a composition, % by mass: C, 98; loss of ignition, 2;

iron of a composition, % by mass: Fe, 99.5; C, 0.1; S, 0.003; P, 0.005; Mn, 0.2; Si, 0.022; Cu, 0.07; Zn, 0.1;

misch metal of a composition, % by mass: rare-earth elements, 98; iron, the balance.

To save cost and simplify the melting technique, the charge can be prepared from other components, e.g.:

silico-calcium of a composition, % by mass: Ca, 31; Si, 65; Fe, 3; Al, 1;

ferro-silicon of composition, % by mass: Si, 90; Mn, 0.2; Cr, 0.2; P, 0.03; S, 0.02; Al, 3.5; Fe, 6.05;

and other materials of suitable composition and competitive cost.

The disclosed percentage of aluminium and silicon in the material for refining steel of multi-purpose application provides for producing a deeply deoxidized metal.

This promotes good desulphurization and provides for reducing the alloying element from their oxides with a maximum percentage recovery. Complex aluminate and silicate nonmetallic inclusions which form in this case are low-melting compounds which readily rise to the surface and pass there over into the slag without impairing its physical and chemical properties (melting point, fluidity, viscosity, the sorption of sulphur and other nonmetallic inclusions, etc.).

A departure from the disclosed aluminium and silicon content of the refining material badly influences the process of deoxidation so that the degree of desulphurization of the metal consequently decreases. Also less alloying elements will be reduced from their oxides due to an altered behaviour of the slag. Its capacity as the sorbent will step down because its fluidity will decreases while the viscosity and melting point will increase. The steel treated with such material will contain much sulphur and other nonmetallic inclusions and its mechanical properties will be low.

The calcium and magnesium present in the disclosed refining material in the disclosed amounts provide for desulphurizing the metal and modifying the nonmetallic inclusions in the course of pouring the metal into the ladle. This yields quality steel.

An altering of the calcium and magnesium content above or below the specified level impairs the refining effect. The sulphur content increases, coarse nonmetallic inclusions are formed, being distributed nonuniformly. Low-grade steel is consequently produced.

The carbon contained in the disclosed refining material in the disclosed amount serves not only as the alloying element but takes part, to a certain extent, in the deoxidation process and promotes desulphurization. The content of nonmetallic inclusions appears to be then at a minimum, for the carbon monoxide formed due to the reaction between the carbon and the oxygen dissolved in the metal escapes without hindrance. The film of each CO bubble is a surfactant which absorbs nonmetallic inclusions and disposes them of into the slag.

A carbon content which is below the specified one makes an additional carbonization of the metal indispensable. This interferes with streamlined processing of metal and degrades product quality. A too high carbon content limits the field of application of the disclosed refining material, rendering it unsuitable for the treatment of low-carbon steel. Also, the percentage of other components decreases in the material whereas that of sulphur and other nonmetallic inclusions increases, affecting product quality. A low degree of reduction of the alloying element makes the production of steel of a specified composition a problem.

The disclosed amount of iron imparts an adequate density to the disclosed refining material and increases the carbon content thereof.

Any altering of the iron content above or below the specified quantity impairs product quality if the steel is treated with the disclosed refining material. A consequent burning out of the elements which are reactive towards oxygen lessens the amount of desulphurization, impairs the reduction of alloying elements and the modification of nonmetallic inclusions.

A preferred embodiment of the invention will now be exemplified as follows.

EXAMPLE 1

The disclosed material for refining steel of multi-purpose application was employed for alloy treatment, using a 350-t teeming ladle with a basic lining.

A semifinished carbon product with a composition (% by mass) of C, 0.05; Si, traces; Mn, 0.05; S, 0.014; P, 0.012; Al, traces; Fe, the balance was tapped from an oxygen blown converter into the ladle at 1640° C. Concurrently, added into the ladle was a heat-treated material rich in manganese protoxide which contained (% by mass) MnO, 53.6; $SiO_2$, 29.1; $Fe_2O_3$, 3.9; $Al_2O_3$, 3.3; $P_2O_5$, 0.83; CaO, 6.6; MgO, 2.1; C, 0.4; S, 0.17. Also added into the ladle at the same time was the disclosed refining material comprising (% by mass) Al, 40; Si, 35; Ca, 5; Mg, 7; C, 10; Fe, the balance. Both additives were introduced into the ladle before the pouring of the semifinished carbon product came to an end.

The heat-treated material rich in manganese protoxide was added in a total amount of 3.8 t, and the material for refining the steel of multi-purpose application, according to the invention, was used in a quantity needed to reduce the manganese protoxide and refine the steel.

This was of a composition (% by mass) as follows: C, 0.11; Mn, 0.49; Si, 0.21; S, 0.003; P, 0.014; Al, 0.024; Fe, the balance. The percentage recovery of manganese amounted to 98.2% and the degree of desulphurization was 78.6%.

The finished steel was poured into a bent-strand continuous casting machine producing a strand with a cross section of 350 by 1650 mm. The strand was cut into billets and these were rolled into plate between 10 and 30 mm thick. The macrodistribution of nonmetallic inclusions in the plate, as determined by metallographic studies in points was: oxides, 1.4; sulphides, 1.6; silicates, 2.1. Quality steel with a low content of sulphur and nonmetallic inclusions was obtained.

EXAMPLE 2

Alloy treatment of metal was confined to the same ladle as in Example 1, using the disclosed material for refining steel of multi-purpose application. The additives were the same as in Example 1.

The semifinished carbon product comprising (% by mass) C, 0.05; Si, traces; Mn, 0.05; S, 0.015; P, 0.014; Al, traces; Fe, the balance was poured from an oxygen blown converter into the basic-lined teeming ladle. Concurrently with the pouring, manganese-rich oxide material was introduced into the ladle together with the disclosed material for refining steel of multi-purpose application which was a mixture of calcium carbide, silicon carbide and aluminium-magnesium-iron alloy. The total composition (% by mass) of the refining material was: Al, 30; Si, 30; Ca, 10; Mg, 5; C, 20; Fe, the balance.

The steel produced was of the following composition, % by mass: C, 0.12; Si, 0.19; Mn, 0.46; S, 0.005; P, 0.015; Al, 0.02; Fe, the balance. The percentage recovery of manganese amounted to 91.4% and the degree of desulphurization was 66.7%.

The steel was poured into a bent-strand continuous casting machine producing a strand with a cross section of 350 by 1650 mm which was cut into billets rolled wherefrom was plate between 10 and 30 mm thick. The macrodistribution of nonmetallic inclusions in the plate, as determined by metallographic studies, was (in points): oxides, 1.5; sulphides, 1.7; silicates, 2. Quality steel with a low content of sulphur and nonmetallic inclusions was obtained.

EXAMPLE 3

Metal was treated with the material for refining steel of multi-purpose application and the finished steel was poured in the same way as in Examples 1, 2, using the same additives.

The semifinished carbon product produced in an oxygen blown converter was of the composition, % by mass: C, 0.06; S, traces; Mn, 0.004; S, 0.016; P, 0.015; Al, traces; Fe, the balance.

The finished steel was of the composition, % by mass: C, 0.11; Si, 0.19; Mn, 0.48; S, 0.006; P, 0.015; Al, 0.025; Fe, the balance. The percentage recovery of manganese amounted to 97.6% and the degree of desulphurization was 62.5%.

The macrodistribution of the nonmetallic inclusions (in points) was: oxides, 1.6; sulphides, 1.8; silicates, 1.8. Quality steel with a low content of sulphur and nonmetallic inclusions was obtained.

EXAMPLE 4

The treatment was carried out with the disclosed material for refining steel of multi-purpose application which was a mixture of the composition (% by mass) as follows: Al, 30; Si, 35; Ca, 5; Mg, 7; C, 20; Fe, the balance.

The melting, refining and pouring techniques were the same as in Examples 1 through 3.

Treated in the ladle was a semifinished carbon product of the composition, % by mass: C, 0.04; Si, traces; Mn, 0.05; S, 0.015; P, 0.015; Al, traces; Fe, the balance, which had been produced in an oxygen blown converter.

The steel so produced was of the following composition, % by mass: C, 0.09; Si, 0.21; Mn, 0.48; S, 0.006; P, 0.016; Al, 0.021; Fe, the balance. The percentage recovery of manganese amounted to 95.4% and the degree of desulphurization was 60%.

The macrodistribution of the nonmetallic inclusions was (in points): oxides, 1.5; sulphides, 1.9; silicates, 2.

EXAMPLE 5

Chromium-alloyed steel was treated in a teeming ladle, using converter slag as the chromium-containing oxide material. The slag composition (% by mass) was as follows: $Cr_2O_3$, 70.84; FeO, 12.13; $Al_2O_3$, 9.35; $SiO_2$, 5.94; MgO, 1.74.

The slag-forming ingredients were lime and fluorspar.

A semifinished carbon product of the composition, % by mass: C, 0.06; Si, traces; Mn, 0.08; S, 0.026; P, 0.012; Al, traces; Cr, 0.1; Ni, 0.59; Cu, 0.51; Fe, the balance, was tapped from a converter into the basic-lined ladle at 1650° C.

Concurrently with pouring the semifinished carbon product, admitted into the ladle were 13.5 t of the chromium-containing oxide material, 1.5 t of the lime and 0.02 t of the fluorspar. Also admitted into the ladle was the disclosed material for refining steel of multi-purpose application in the form of an alloy of the composition, % by mass: Al, 37; Si, 25; Ca, 15; Mg, 7; C, 12; Fe, the balance. Other alloying elements were introduced by adding ferroalloys.

The steel so produced was of the composition, % by mass: C, 0.1; Si, 0.95; Mn, 0.62; Al, 0.035; S, 0.007; P, 0.015; Cr, 0.87; Ni, 0.59; Cu, 0.51; Fe, the balance. The percentage recovery of chromium amounted to 86.2%, and the degree of desulphurization was 73.1%.

The billets produced on a continuous-casting machine were rolled into plate as in Examples 1 and 2, and the plate was subjected to metallographic studies. These have shown that the content of nonmetallic inclusions was less than in previous examples, proving a better quality of the product. The content of nonmetallic inclusions (in points) was: oxides, 1.5; sulphides, 1.8; silicates, 1.9.

EXAMPLE 6

Metal was treated and poured in the same way as in previous examples, using the same materials as in Example 5.

The semifinished carbon product produced in an oxygen blown converter was of the composition (% by mass) as follows: C, 0.06; Si, traces; Mn, 0.05; S, 0.022; P, 0.012; Al, traces; Cr, 0.13; Ni, 0.68; Cu, 0.55; Fe, the balance. In pouring the carbon product into the teeming ladle, added there into was the material for refining steel of multi-purpose application in the form of a mixture comprising, % by mass: Al, 35; Si, 30; Ca, 7; Mg, 5; C, 20; rare-earth elements, 1; Fe, the balance.

The product was steel of the following composition, % by mass: C, 0.12; Si, 1.01; Mn, 0.73; S, 0.007; P, 0.013; Al, 0.023; Cr, 0.9; Ni, 0.68; Cu, 0.55; Fe, the balance. The percentage recovery of chromium amounted to 96.2%, and the degree of desilphurization was 68.2%.

The metallographic studies of the finished steel revealed the following content of nonmetallic inclusions (in points): oxides, 1.6; sulphides, 1.7; silicates, 1.6. The inclusions were present in the fine globular form.

EXAMPLE 7

The chromium-containing material for refining steel of multi-purpose application was fed into a teeming ladle in the course of pouring thereinto a semifinished carbon product which was produced in an oxygen blown converter and was of the composition (% by mass) as follows: C, 0.05; Si, traces; Mn, 0.05; S, 0.021; P, 0.015; Al, traces; Cr, 0.1; Ni, 0.69; Cu, 0.53; Fe, the balance.

In use were the same chromium oxide-containing and slag-forming materials as in Examples 5 and 6.

Also in use was the disclosed material for refining steel of multi-purpose application in the form of a mixture of calcium carbide, silicon carbide and an alloy containing aluminium, magnesium, rare-earth elements and iron. The content of the refining material was as follows, % by mass: Al, 30; Si, 28; Ca, 15; Mg, 6; C, 10; rare-earth elements, 3; Fe, the balance.

The treatment was finished by the time the pouring of the semifinished carbon product into the ladle was over.

The steel so produced was of the composition, % by mass: C, 0.1; Si, 1.08; Mn, 0.72; S, 0.007; P, 0.015; Al, 0.024; Cr, 0.87; Ni, 0.69; Cu, 0.53; Fe, the balance. The percentage recovery of chromium amounted to 96.2%, and the degree of desulphurization was 66.7%.

The metallographic studies of the steel showed the following content of nonmetallic inclusions (in points): oxides, 1.4; sulphides, 1.6; silicates, 1.7. The inclusions were present in the fine globular form.

EXAMPLE 8

Used were the same chromium oxide-containing and slag-forming materials as in Examples 5 through 7. The technique of melting, treating and pouring was the same as in these Examples.

The semifinished carbon product subjected to the refining was of the composition, % by mass: C, 0.05; Si, traces; Mn, 0.07; S, 0.022; P, 0.013; Al, traces; Cr, 0.1; Ni, 0.68; Cu, 0.53; Fe, the balance.

The disclosed refining material was used in the form of an oxide material of the composition (% by mass) as follows: Al, 40; Si, 26; Ca, 10; Mg, 6; C, 12; rare-earth elements, 5; Fe, the balance.

The refined steel was of the following composition, % by mass: C, 0.1; Si, 1; Mn, 0.73; S, 0.006; P, 0.013; Al, 0.026; Cr, 0.88; Ni, 0.68; Cu, 0.53; Fe, the balance. The percentage recovery of chromium amounted to 97.5%, and the degree of desulphurization was 72.7%.

The steel, on being poured and rolled, was subjected to metallographic studies which showed that the content of nonmetallic inclusions (in points) was as follows: oxides, 1.7; sulphides, 1.4; silicates, 1.6.

Quality steel was produced with a low sulphur content. The nonmetallic inclusions were in the form of fine globules uniformly distributed over the volume of the metal.

EXAMPLE 9

Steel of multi-purpose application was alloyed with manganese, using the disclosed refining material in the form of an alloy of the composition, % by mass: Al, 32; Si, 35; Ca, 8; Mg, 7; C, 11; rare-earth elements, 1.5; Fe, the balance.

The manganese-containing oxide material was of the same content as in Example 5 and was added in the same amount.

The semifinished carbon product subjected to the refining was of the following composition, % by mass: C, 0.05; Si, traces; Mn, 0.05; S, 0.016; P, 0.015; Al, traces; Fe, the balance.

The steel so obtained was of the composition, % by mass: C, 0.1; Si, 0.22; Mn, 0.48; S, 0.005; P, 0.015; Al, 0.022; Fe, the balance. The percentage recovery of manganese was 95.6%, and the degree of desulphurization was 68.8%.

The content of nonmetallic inclusions (in points) was: oxides, 1.4; sulphides, 1.7; silicates, 1.9.

EXAMPLE 10

A semifinished carbon product containing in % by mass C, 0.06; Si, traces; Mn, 0.05; S, 0.018; P, 0.015; Al, traces; Fe, the balance was refined with the disclosed material in the form of an alloy of the composition (% by mass) as follows: Al, 38; Si, 28; Ca, 10; Mg, 7; C, 12; rare-earth elements, 2; Fe, the balance.

Other materials used for the alloy treatment were the same as in Examples 1 through 4 and 9.

The steel produced was of the composition, % by mass: C, 0.1; Si, 0.18; Mn, 0.47; S, 0.006; P, 0.015; Al, 0.021; Fe, the balance. The percentage recovery of manganese amounted to 93,2%, and the degree of desulphurization was 66.7%.

The steel was poured, rolled and examined metallographically in the same way as in Example 1.

The content of nonmetallic inclusions (in points) was as follows: oxides, 1.5; sulphides, 1.7; silicates, 1.8.

Quality steel with a low-sulphur content which also contained nonmetallic inclusions in an advantageous form and of a favourable structure was produced in this way.

INDUSTRIAL APPLICABILITY

The present invention will turn to advantage in refining steel when its alloying is carried out by reducing the alloying element from an oxide-containing material as this is the case, e.g. in ladle refining manganese steel of multi-purpose application. The degree of desulphurization is 60–80%, and the content of nonmetallic inclusions (in points) is: oxides, 1–2; sulphides, 1–2; silicates, 1.5–2.5.

We claim:

1. A material for refining steel of multi-purpose application, containing aluminum, silicon, calcium, magnesium, carbon and iron, characterized in that it contains said components in the following proportions, % by mass:

| | |
|---|---|
| aluminium | 30–40 |
| silicon | 35–25 |
| calcium | 5–15 |
| magnesium | 7–5 |
| carbon | 20–10 |
| iron | the balance. |

2. A material as claimed in claim 1, characterized in that it contains additionally rare-earth elements and incorporates the components in the following proportions, % by mass:

| | |
|---|---|
| aluminium | 30–40 |
| silicon | 30–25 |
| calcium | 15–5 |
| magnesium | 5–7 |
| carbon | 10–20 |
| rare-earth elements | 5–1 |
| iron | the balance. |

3. A material as claimed in claim 1, characterized in that it contains additionally rare-earth elements and incorporates the components in the following proportion, % by mass:

| | |
|---|---|
| aluminium | 30–40 |
| silicon | 35–25 |

-continued

| | |
|---|---|
| calcium | 15–5 |
| magnesium | 5–7 |
| carbon | 10–12 |
| rare-earth elements | 1–2 |
| iron | the balance. |

* * * * *